US005152662A

United States Patent [19]

Hirst et al.

[11] Patent Number: 5,152,662

[45] Date of Patent: Oct. 6, 1992

[54] INSPECTION APERTURE SEALING

[75] Inventors: Roy T. Hirst, Derby; Gerard Sharkey, Burton, both of England

[73] Assignee: Rolls-Royce plc, London, England

[21] Appl. No.: 690,275

[22] Filed: Apr. 24, 1991

[30] Foreign Application Priority Data

May 17, 1990 [GB] United Kingdom ..... 9011067

[51] Int. Cl.[5] ..... F02G 1/00

[52] U.S. Cl. ..... 415/118; 415/201; 60/39.33

[58] Field of Search ..... 415/118, 201; 60/39.33; 356/241

[56] References Cited

U.S. PATENT DOCUMENTS

| | | | |
|---|---|---|---|
| 2,965,286 | 12/1960 | Ledwith et al. | 415/201 |
| 3,362,160 | 1/1960 | Bourgeois | 415/118 |
| 3,936,217 | 2/1976 | Travaglini et al. | 415/118 |
| 4,406,580 | 9/1983 | Baran, Jr. . | |
| 4,815,276 | 3/1989 | Hansel et al. . | |
| 4,825,642 | 5/1989 | Radtke | 415/118 |
| 5,079,910 | 1/1992 | Hirst et al. | 60/39.33 |

FOREIGN PATENT DOCUMENTS

| | | | |
|---|---|---|---|
| 1193274 | 11/1985 | U.S.S.R. | 415/118 |
| 941239 | 11/1963 | United Kingdom . | |
| 947559 | 1/1964 | United Kingdom . | |

*Primary Examiner*—Edward K. Look
*Assistant Examiner*—James A. Larson
*Attorney, Agent, or Firm*—Oliff & Berridge

[57] ABSTRACT

An inspection access feature suitable for use in an inspection aperture in the casing of a gas turbine engine. The feature comprises a body portion which locates in the aperture and a removable plug portion which locates in an aperture extending through the body portion. The plug portion prevents the leakage of gases from a gas passage within the casing. If the plug portion is inadvertently not fitted, gas leakage from the casing is prevented by a pivoted flap which pivots to block the aperture through the body portion.

8 Claims, 1 Drawing Sheet

INSPECTION APERTURE SEALING

BACKGROUND OF THE INVENTION

1. Field of the Invention

This invention relates to the sealing of inspection apertures and in particular to the sealing of inspection apertures in the casing of a gas turbine engine.

2. Description of Related Art

It is common practice to provide apertures in the casing of a gas turbine engine to facilitate the inspection of engine components such as those of the engine compressor, combustion equipment and turbine which are located within the casing. Typically those engine components are inspected using a device known as a boroscope. This is an elongate, usually flexible, device which is passed through the inspection aperture. It contains a light guide which permits viewing of otherwise inaccessible engine components.

Obviously when the engine has been inspected, the apertures must be sealed in order to prevent the leakage of high pressure gases which are present within those engine components during engine operation. Commonly the apertures are sealed by the positioning of a plug within the aperture.

While such sealing devices are usually effective in preventing the leakage of engine gases, it is possible for them to be improperly fitted or even not fitted at all after an inspection has been carried out. If this occurs, gas leakage will occur during engine operation. Such leakage is highly undesirable in view of the damage it can cause as well as result in a serious fall in engine efficiency and perhaps the activation of fire warning detectors.

SUMMARY OF THE INVENTION

It is an object of the present invention to provide an inspection access feature suitable for the casing of a gas turbine engine which tends to self-seal against gas leakage therethrough in the event of its incorrect or incomplete assembly.

According to the present invention, an inspection access feature suitable for use on the casing of a gas turbine engine comprises a body portion for location in an inspection aperture in said casing, and a removable plug portion for location in an aperture extending through said body portion, said plug portion being so configured to normally engage and seal an aperture in a pressure vessel located internally of said casing and additionally seal said aperture extending through said body portion both when said plug portion does and when it does not seal said aperture in said pressure vessel, said body portion being provided with a pivotally mounted flap member which is pivotable between a first position in which it blocks said aperture extending through said body portion to resist leakage from said casing and a second position in which it permits the location of said plug portion in said aperture extending through said body portion, said flap member being so adapted as to be biassed towards said first position.

BRIEF DESCRIPTION OF THE DRAWINGS

The invention will now be described, by way of example, with reference to the accompanying drawings in which.

DETAILED DESCRIPTION OF THE PREFERRED EMBODIMENTS

Figure 1:
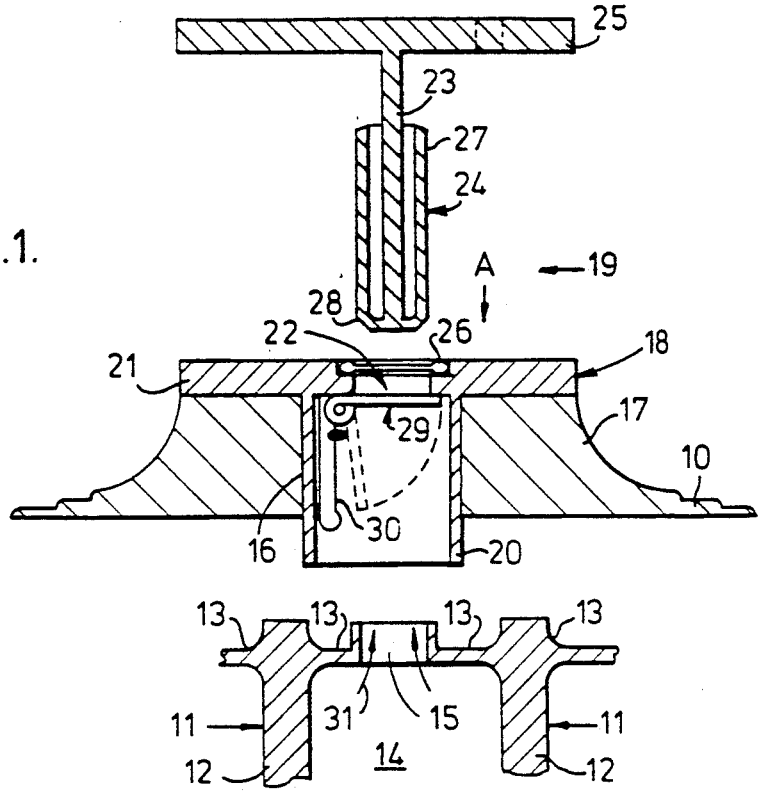
FIG. 1 is a sectioned side view in partially exploded form showing an inspection access feature in accordance with the present invention located in the turbine casing of a gas turbine engine.

With reference to the drawings, the casing 10 of a gas turbine engine (not shown) is of generally circular cross-sectional shape and encloses an annular array of nozzle guide vanes 11, the radially outer extents of which are visible in FIGS. 1 and 5. The nozzle guide vanes 11 are of conventional construction comprising aerofoil section portions 12 and radially outer shroud portions 13. The shroud portions 13 of adjacent nozzle guide vanes 11 abut each other so as to define the radially outermost boundary of an annular motive fluid passage 14 extending through the gas turbine engine casing 10. Since, in operation, the gas contained within the motive fluid passage 14 is at high pressure, the structure defined by the nozzle guide vanes can be considered to be a pressure vessel.

Such a turbine construction is conventional and therefore will not be described in further detail.

Certain adjacent nozzle guide vane shroud portions 13 are so configured that they define circular cross-section apertures 15. The apertures 15 are aligned with corresponding apertures 16 provided in bosses 17 provided on the turbine casing 10.

The apertures 15 and 16 are so dimensioned as to permit the passage therethrough of visual inspection apparatus, such as a boroscope tube, to provide visual inspection of the nozzle guide vanes 11 and associated structure.

Figure 2:
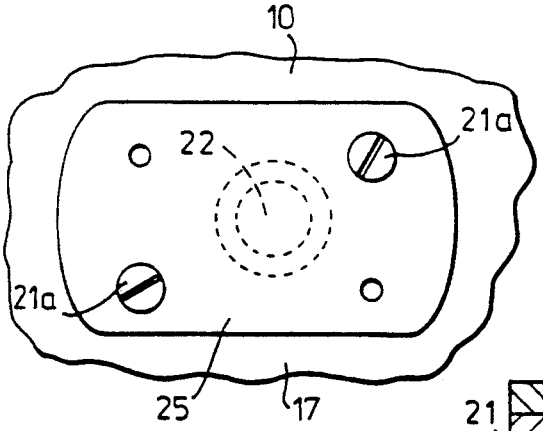
FIG. 2 is a view on arrow A of FIG. 1.

Each of the apertures 16 in the turbine casing 10 receives the body portion 18 of an inspection access feature in accordance with the present invention generally indicated at 19. The body portion 18 comprises a hollow cylindrical part 20 which locates within the casing aperture 16 and a flat plate part 21 which locates in a corresponding flat surface on the outer extent of the boss 17. Screws 21*a* which can be seen in FIG. 2, maintain the flat plate part 21 in position on the boss 17.

The flat plate part 18 is provided with a stepped diameter circular cross-section aperture 22 to facilitate access to the interior of the turbine casing 10 and the nozzle guide vanes 11.

A plug portion 23, which is of generally T-shaped cross-section is the other part of the inspection access feature A and is adapted to locate within the body portion 18. The plug portion 23 comprises a cylindrical part 24 which passes through the stepped diameter aperture 22 in the flat plate part 18 and locates in sealing engagement in the aperture 15 defined by the nozzle guide vane shrouds 13. The cylindrical part 24 thereby prevents the leakage of gases from the motive fluid passage 14.

Figure 3:
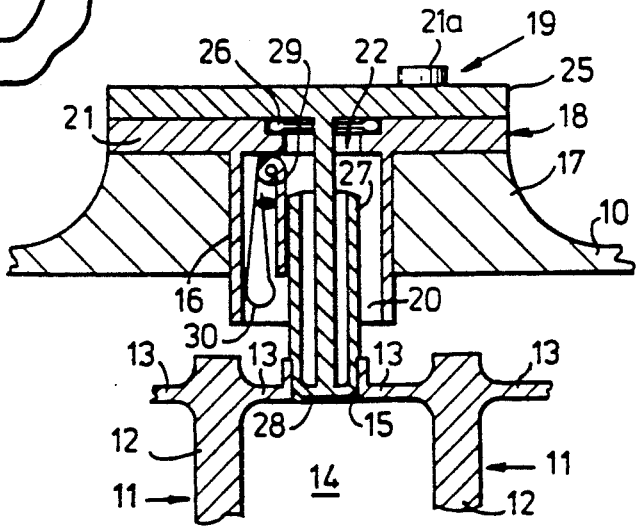
FIG. 3 is a view similar to that shown in FIG. 1 differing in that the plug portion of the inspection access feature is shown in its fully installed position.

The plug portion 23 also comprises a flat plate part 25 which, when the cylindrical plug portion part 23 is located in the shroud aperture 15, abuts the flat plate part 21 of the body portion 18 as can be seen in FIG. 3. A C-cross section seal 26 located within the stepped diameter aperture 22 ensures a gas-tight seal between the plate parts 21 and 25. Screws (not shown) maintain the plug portion 23 in position in the body member 18.

It will be seen therefore that when the plug portion 23 is fully located within the body member 18 as shown in FIG. 3, the leakage of gas from the motive fluid passage 14 is prevented both by the sealing location of cylindrical plug portion part 24 in the shroud aperture 15 and the sealing abutment between the flat plate parts 21 and 25.

In the event that the flat plate part 25 of the plug portion 23 is incorrectly fitted to the body member flat plate part 21, it is possible that the cylindrical plug portion part 24 may not be located within the shroud aperture 15. Gas leakage through the shroud aperture 15 could thereby occur. In order to limit the leakage of gases escaping from the turbine casing 10 to acceptable levels, the cylindrical plug portion part 24 is of such a length that its outer end 27 locates in partially sealing engagement within the smaller diameter part of the stepped diameter aperture 22 if its inner end 28 is not located within the shroud aperture 15.

In order to facilitate visual inspection of the nozzle guide vanes 11, the plug portion 23 is removed completely. There is a danger therefore that the replacement of the plug portion 23 could be forgotten before engine running is commenced.

In order to limit or prevent gas leakage from the casing 10 in this eventuality, a pivotally mounted flap 29 is provided within the hollow cylindrical part 20 of the body member 18. The flap 29 is located adjacent the underside of the plug portion flat plate part 21 adjacent the stepped diameter aperture 22. It pivots between a second position shown in FIG. 3 where it permits the location of the plug portion 23 within the body portion 18 and a first position shown in full lines in FIG. 1 in which it blocks the stepped diameter aperture 22.

A spring 30 biasses the flap 29 to the position shown in solid lines in FIG. 1 when the plug portion 23 is not in place. This ensures that the leakage flow of gases through the shroud aperture 15 as indicated by the arrows 31 acts upon the flap 29 to cause it to pivot to the first position shown in FIG. 1 in which gas leakage from the turbine casing 10 is limited or prevented. If the inspection access feature 19 were to be fitted on the underside of the engine gravity would of course assist in the pivoting of the flap 29 to the first position.

It will be seen therefore that the inspection access feature 19 in accordance with the present invention limits or prevents gas leakage from the turbine casing 10 both when the core member 23 is incorrectly fitted and when it is not present.

We claim:

1. An inspection access feature suitable for use on a gas turbine engine casing, comprising: a body portion for location in an inspection aperture in said casing, and a removable plug portion for location in an aperture extending through said body portion, said plug portion being so configured as to normally engage and seal an aperture in a pressure vessel located internally of said casing and additionally seal said aperture extending through said body portion both when said plug portion does and when it does not seal said aperture in said pressure vessel, said body portion being provided with a pivotally mounted flap member which is pivotable between a first position in which it blocks said aperture through said body portion to resist leakage from said casing and a second position in which it permits the location of said plug portion in said aperture extending through said body portion, biasing means being provided to bias said flap member towards said first position, wherein said body portion further comprises a hollow cylindrical part locatable in said casing inspection aperture and a plate part locatable on a corresponding surface on said casing, said aperture extending through said body portion being defined by both said plate and said hollow cylindrical part.

2. The inspection access feature as claimed in claim 1 wherein said plug portion comprises a plate part which corresponds with, and in operation abuts, said plate part of said body portion, and a substantially cylindrical part which, in operation, extends through said aperture in said body portion to seal said aperture in said pressure vessel.

3. The inspection access feature as claimed in claim 2 wherein sealing means are provided between said plate part on said body portion and said plate part on said plug portion.

4. The inspection access feature as claimed in claim 2 wherein said aperture defined by said plate part of said body portion and a portion of said cylindrical plug portion part which locates within said plate part aperture when said cylindrical plug member part is not in sealing engagement with said pressure vessel aperture, correspond in cross-sectional configuration so that they cooperate to define a seal.

5. The inspection access feature as claimed in claim 1 wherein said pivotally mounted flap member is located within said hollow cylindrical part of said body portion.

6. The inspection access feature as claimed in claim 5 wherein said pivotally mounted flap member is caused to pivot from said first position to said second position by the engagement thereof with said cylindrical part of said plug portion upon the insertion of said plug portion into said body portion.

7. The inspection access feature as claimed in claim 6 wherein said pivotally mounted flap member is maintained in said second position by the engagement thereof with said cylindrical part of said plug portion when said plug portion is located in said aperture extending through said body portion.

8. The inspection access feature as claimed in claim 1 wherein said pivotally mounted flap member is biased towards said first position by spring means.

* * * * *